United States Patent [19]

Hayashi

[11] Patent Number: 4,523,288

[45] Date of Patent: Jun. 11, 1985

[54] INTERVAL-EXPANDING TIMER

[75] Inventor: Mishio Hayashi, Saitama, Japan

[73] Assignee: Takeda Riken Co., Ltd., Tokyo, Japan

[21] Appl. No.: 356,730

[22] Filed: Mar. 10, 1982

[30] Foreign Application Priority Data

Mar. 16, 1981 [JP] Japan ..... 56-37448

[51] Int. Cl.[3] ..... G04F 10/04

[52] U.S. Cl. ..... 364/569; 377/20

[58] Field of Search ..... 364/569, 571, 830, 833; 328/129.1, 130.1; 377/19, 20

[56] References Cited

U.S. PATENT DOCUMENTS 3,784,919 1/1974 Azegami ..... 364/833 X 4,267,436 4/1981 Hayashi ..... 377/20

*Primary Examiner*—Edward J. Wise

*Assistant Examiner*—Edward R. Cosimano

*Attorney, Agent, or Firm*—Staas & Halsey

[57] ABSTRACT

An interval-expanding timer compensated for drift and nonlinearity in which a time interval $\Delta T+nT_0$ of the sum of a time interval $\Delta T$ to be measured and a constant time interval $nT_0$ and time intervals $(n+1)T_0$ and $nT_0$ are respectively measured after being expanded and the expression $$\frac{(\Delta T + nT_0) - nT_0}{(n+1)T_0 - nT_0} \times T_0$$

is calculated based on the measured results, thereby to measure the time interval $\Delta T$. The expansion of the time intervals is carried out in the following manner: A fixed voltage is integrated by a first integrator for a given period of time, and the fixed voltage is integrated by a second integrator at an integration rate smaller than that of the first integrator. Coincidence is detected between the integrated outputs from the first and second integrators, and the time interval from the start of integration by the second integrator to the detection of coincidence is provided as the interval-expanded output. The time intervals $\Delta T+nT_0$, $(n+1)T_0$ and $nT_0$ are each expanded by such a method.

17 Claims, 40 Drawing Figures

PRIOR ART
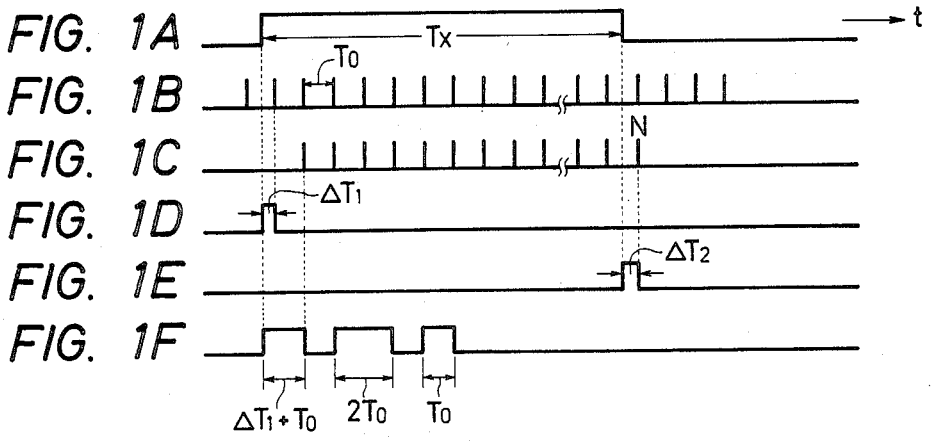
FIG. 2 PRIOR ART
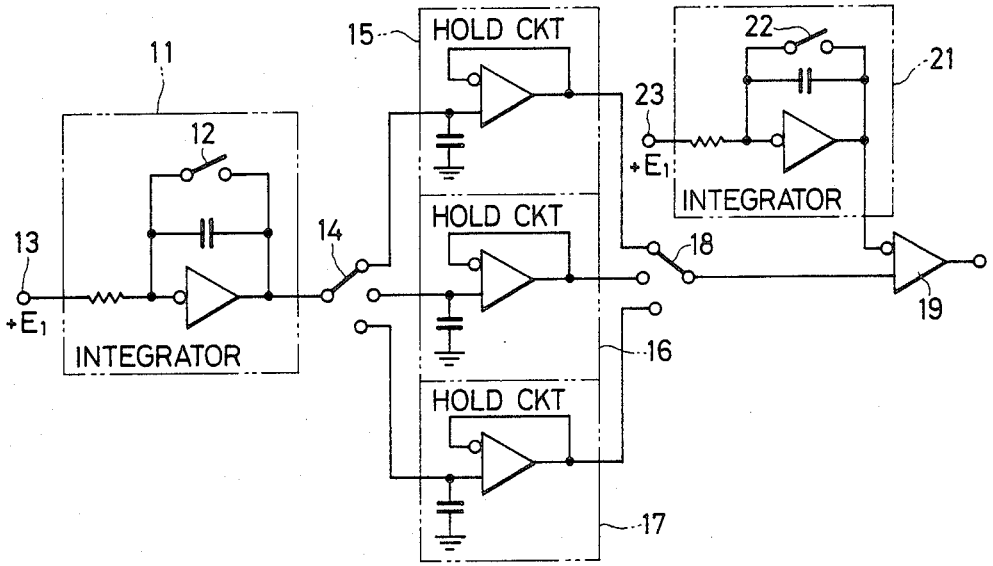

FIG. 3
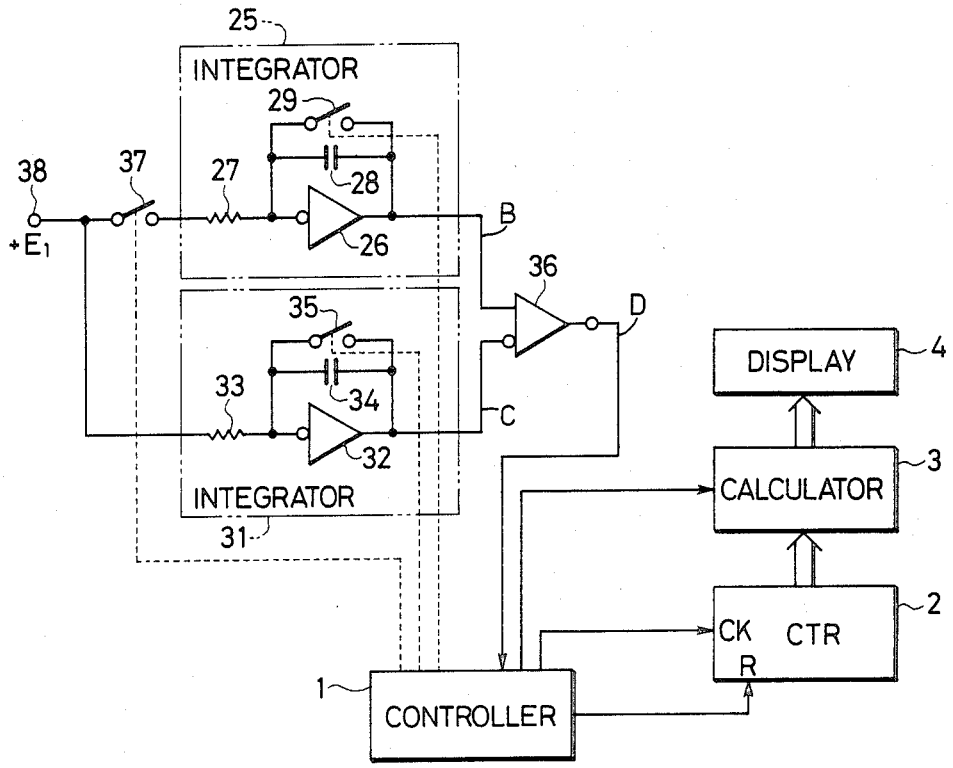
FIG. 4A
FIG. 4B
FIG. 4C
FIG. 4D
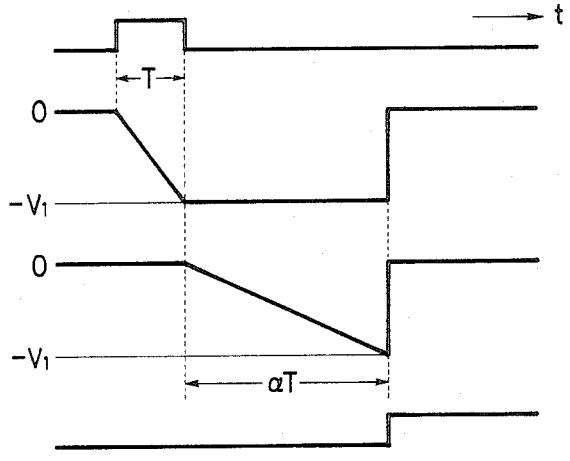

t
ΔT1
T0
t1
t2
t3
t4
t5
t6
t7
t8
t9
t10
t11
V1
V2
V3
Ta
0

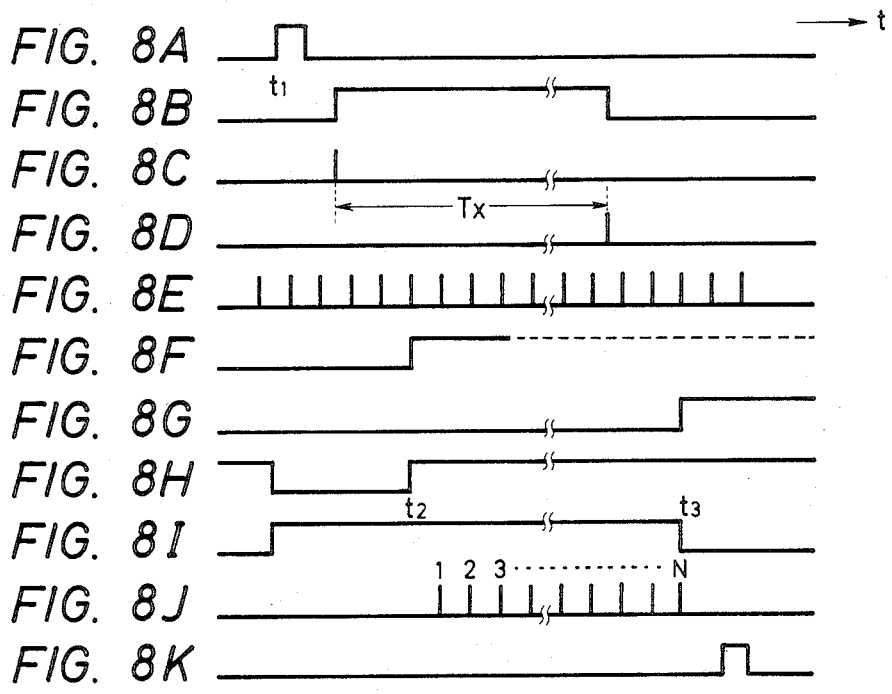
FIG. 9
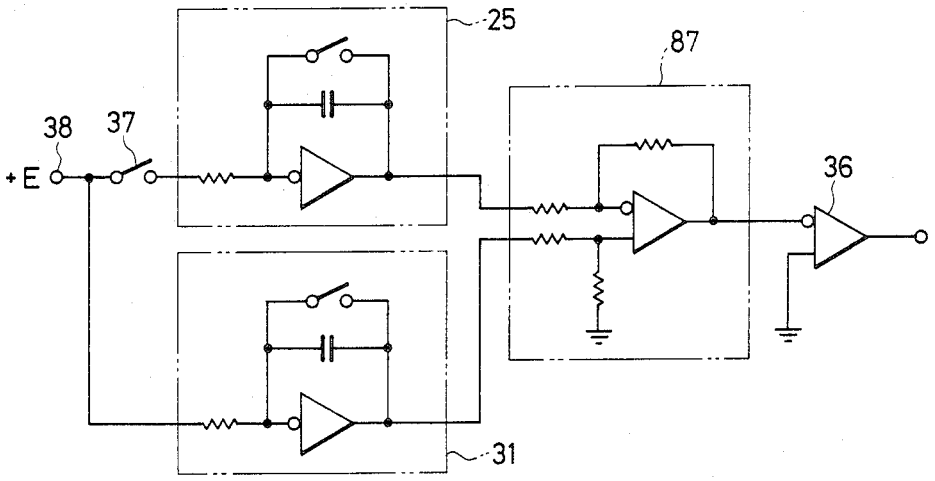

INTERVAL-EXPANDING TIMER

BACKGROUND OF THE INVENTION

The present invention relates to a timer for measuring a time interval, for instance, by counting clock pulses, and more particularly to a time interval measuring instrument which measures a time interval, with high accuracy, by expanding a fraction of the clock period to thereby compensate for drift and nonlinearity.

For the measurement of a time interval $\Delta T$ that is desired to be obtained, a time interval equivalent to an addition of $\Delta T$ and a constant $nT_0$ (n being a positive integer and $T_0$ a fixed value) is measured after being expanded at a fixed rate, and constant time intervals $(n+1)T_0$ and $nT_0$ are respectively measured after similarly being expanded at the abovesaid fixed rate. The following expression is calculated using the measured results of the time intervals $\Delta T+nT_0$, $(n+1)T_0$ and $nT_0$:

$$\frac{(\Delta T + nT_0) - nT_0}{(n+1)T_0 - nT_0} \times T_0$$

Such interval expansion measurements can be achieved with high accuracy. In addition, by expanding the time interval added with the fixed value $nT_0$ as described above, a linear expansion can be done even though the time interval $\Delta T$ is very short and even though the expansion characteristic of the interval expanding means is nonlinear in a small input time interval region. Furthermore, even if a temperature drift exists in the expanding means, the drift component is removed by the calculation of the abovementioned expression, ensuring accurate measurement. Such a time interval measuring instrument is disclosed in U.S. Pat. No. 4,267,436 entitled "Interval-Expanding Timer Compensated for Drift and Nonlinearity", issued on May 12, 1981. According to the interval expanding means set forth in this U.S. patent, the aforesaid time intervals $\Delta T_1+nT_0$, $(n+1)T_0$ and $nT_0$ are respectively converted by a common integrator into voltages, which are held in individual voltage hold circuits. Coincidence is detected between each of the voltages held in the hold circuits and the integrated output from an integrator lower in integration rate than the abovesaid integrator, and the period of time from the start of integration by the latter integrator to the detection of coincidence is yielded as an output of the expanded time interval. In the prior art, for the three voltages, hold circuits are employed as referred to above, and dispersion in their characteristics due to temperature variations and aging introduces errors in measurement.

It is therefore an object of the present invention to provide a time interval measuring instrument which is insusceptible to the influence of ambient temperature change and aging.

Another object of the present invention is to provide a time interval measuring instrument which permits simplification of the arrangement of a controller and other circuits in the instrument.

SUMMARY OF THE INVENTION

According to the present invention, a fixed voltage is integrated by a first integrator for given periods of time, i.e., for each one of the time intervals $\Delta T+nT_0$, $(n+1)T_0$ and $nT_0$, and then the fixed voltage is integrated by a second integrator of a lower integration rate than that of the first integrator. The integrated outputs from the first and second integrators are compared for the detection of coincidence therebetween. The period of time from the start of integration by the second integrator to the detection of coincidence is an output of the expanded time interval. This operation is carried out for each of the time intervals $\Delta T+nT_0$, $(n+1)T_0$ and $nT_0$, and no use is made of the voltage hold circuits employed in the conventional instrument. Accordingly, the present invention is free from such a likelihood of dispersion being introduced in the characteristics of the voltage hold circuits as referred to above.

The first and second integrators are controlled in the following manner. A pulse shifted by $\Delta T_1$ relative to a clock pulse is applied to a first switching signal generator to trigger it, producing a first switching signal. By the first switching signal the first integrator starts its integrating operation. The first switching signal drives delay means to yield an output synchronized with a clock pulse delayed by the time $nT_0$ or $(n+1)T_0$ in accordance with the state of the output from a sequencer. At the start of the integration, a delay of the time $nT_0$ is performed, and consequently a delayed output $\Delta T_1+nT_0$ is obtained. Driven by the output from the delay means, a second switching signal generator produces a second switching signal, by which the input to the first integrator is cut off. Its integrated value obtained so far is held, and integration by the second integrator is started by the second switching signal. At the end of the second switching signal the sequencer is stepped and a clock-synchronized trigger generating means is triggered. The clock-synchronized trigger generating means yields a trigger pulse in accordance with the state of the output from the sequencer and, by this trigger pulse, the first switching signal generator is driven again. Thereafter, the operations described above are repeated but, this time, the delay means provides an output delayed by $(n+1)T_0$ and when the first switching signal is generated, the delay means provides an output delayed by $nT_0$.

In this way, the time intervals $\Delta T_1+nT_0$, $(n+1)T_0$ and $nT_0$ are produced in a sequential order and the switching signals for controlling the first and second integrators are obtained with a relatively simple arrangement. Further, the three voltage hold circuits used in the prior art are not needed. Accordingly, the time interval measuring instrument of the present invention can be simplified in construction as a whole.

BRIEF DESCRIPTION OF THE DRAWINGS

FIGS. 1A to F are timing charts explanatory of the conventional time interval measuring instrument;

FIG. 2 is a circuit diagram illustrating the conventional time interval measuring instrument;

FIG. 3 is a circuit diagram of an example of the time interval measuring instrument of the present invention, illustrating a specific arrangement of a time interval expanding unit which forms the principal part of the instrument;

FIGS. 4A to D are wave form diagrams explanatory of the operation of the instrument shown in FIG. 3;

FIGS. 8A to F are timing charts explanatory of the operation of the embodiment shown in FIG. 7; and FIG. 9 is a connection diagram showing a modified form of the time interval expanding unit.

DESCRIPTION OF THE PREFERRED EMBODIMENTS

Figure 5:
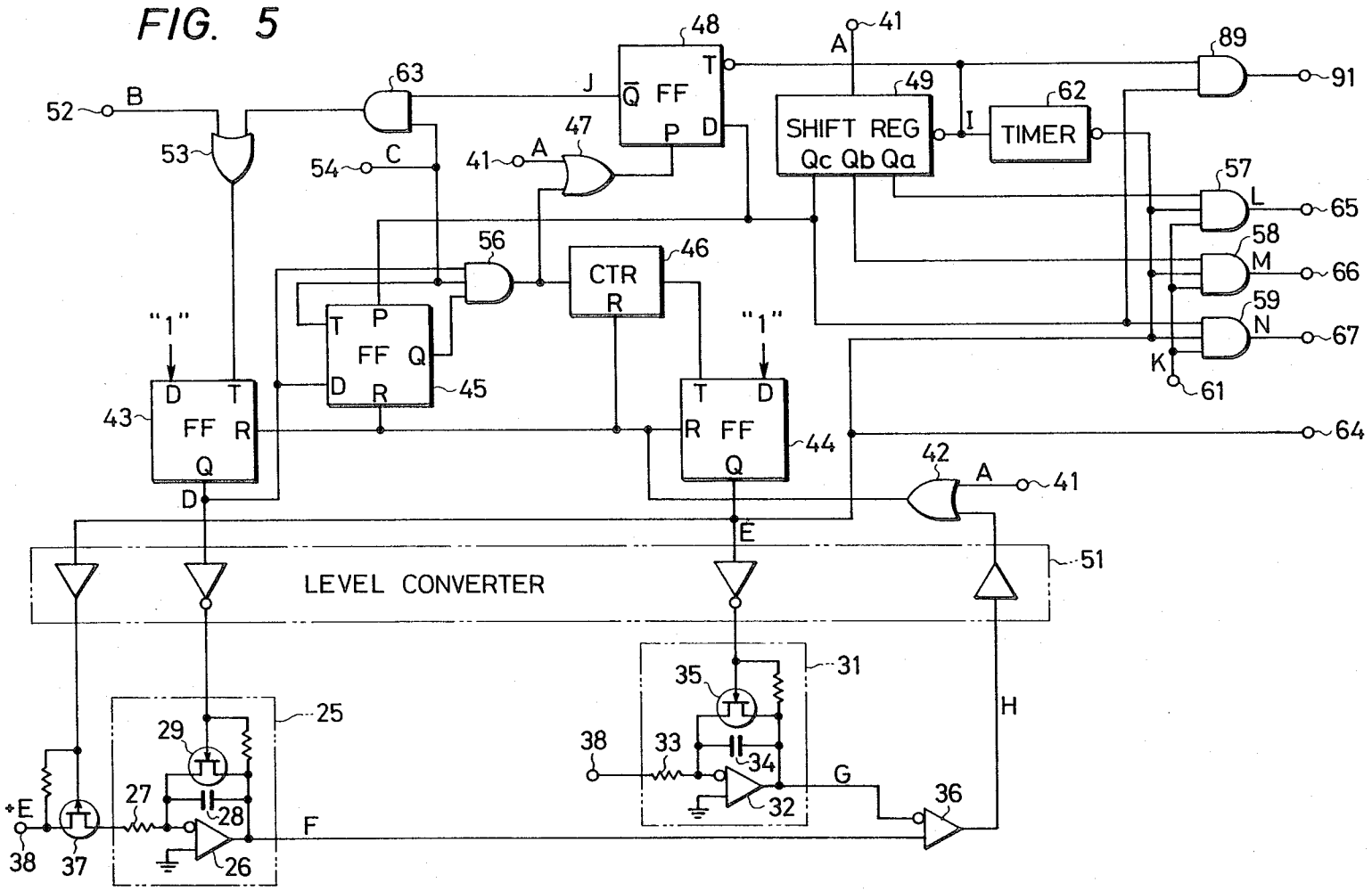
FIG. 5 is a circuit diagram illustrating an embodiment of the time interval measuring instrument of the present invention.

To facilitate a better understanding of the present invention, a description will be given first of the prior art. For instance, clock pulses having a period $T_0$, shown in FIG. 1B, are gated for a time interval Tx to be measured, depicted in FIG. 1A, thereby to obtain a gate output shown in FIG. 1C, and then a count is taken of the number N of the gated clock pulses. At the same time, a time interval $\Delta T_1$ between the beginning of the time Tx to be measured and the next successive clock pulse, as shown in FIG. 1D, and a time interval $\Delta T_2$ between the end of the time Tx and the next successive clock pulse, as shown in FIG. 1E, are detected. Then, these detected time intervals $\Delta T_1$ and $\Delta T_2$ are measured by using clock pulses of a frequency sufficiently higher than that of the clock pulses of FIG. 1B, or after they are expanded. From these measured values, the calculation $NT_0+\Delta T_1-\Delta T_2$ yields a value of the time interval Tx with high accuracy.

In this case, although the time intervals $\Delta T_1$ and $\Delta T_2$ are very short, they can be measured with high accuracy through utilization of a time expansion circuit mentioned above, which can be formed of an inexpensive structure. If, however, the time intervals $\Delta T_1$ and $\Delta T_2$ assume values in the range of 0 to $T_0$, and if they are very short time intervals close to 0, there is the possibility that they enter into a nonlinear region of the conversion characteristic of a time-voltage converter used for their expansion. Furthermore, it cannot also be ignored that the conversion characteristic of the time-voltage converter is subject to the influence of ambient temperature. In view of the above, it was proposed in the aforementioned U.S. patent to measure the time interval $\Delta T_1$, for instance, by producing three pulses such as shown in FIG. 1F, i.e. a pulse of a duration $\Delta T_1+nT_0$ ($n=1$ in FIG. 1F), a pulse of a constant duration $(n+1)T_0$ longer than the constant duration $nT_0$ and a pulse of the constant duration $nT_0$, measuring the durations of these pulses after expanding them, and then calculating the following expression from the measured values:

$$\frac{(\Delta T_1 + nT_0) - nT_0}{(n+1)T_0 - nT_0} \times T_0 \qquad (1)$$

In this conventional instrument the time expansion is carried out in the following manner. As illustrated in FIG. 2, a fixed voltage $+E_1$ at a terminal 13 is integrated by an integrator 11 with its reset switch 12 held in the OFF state for the time interval $\Delta T_1+nT_0$ and the integrated output is applied via a changeover switch 14 to a hold circuit 15 in which it is stored. Then the changeover switch 14 is switched to a hold circuit 16 and the abovesaid fixed voltage $+E_1$ is integrated with the reset switch 12 held in the OFF state for the time interval $(n+1)T_0$ and the integrated output is stored in the hold circuit 16. Next, the changeover switch 14 is connected to another hold circuit 17 and an integrated output obtained by similarly integrating the fixed voltage $+E_1$ for the time interval $nT_0$ is stored in the hold circuit 17. Thereafter, the output from the hold circuit 15 is applied via a changeover circuit 18 to one input of a comparator 19 and a fixed voltage $+E_1$ at a terminal 23 is integrated by an integrator 21 with its reset switch 22 held in the OFF state. The integrated output is provided to the other input of the comparator 19 for the detection of coincidence between both inputs thereto. In this instance, the integration time constant of the integrator 21 is selected larger than the integration time constant of the integrator 11; namely, the integrator 21 performs the integration at a lower rate than does the integrator 11. Thus the time interval between the start of integration by the integrator 21 with the switch 18 connected to the hold circuit 15 and the detection of coincidence by the comparator 19 is obtained as an expansion of the time interval $\Delta T_1+nT_0$. Similarly, expanded outputs of the time intervals $(n+1)T_0$ and $nT_0$ are respectively obtained by connecting the hold circuits 16 and 17 to the comparator 19 via the switch 18.

With the prior art equipment described above, however, the characteristics of the hold circuits 15, 16 and 17 are subject to aging and variations due to ambient temperature changes, and in particular, an offset voltage undergoes variations to introduce dispersion in the characteristics of the hold circuits 15, 16 and 17, resulting in measurement errors.

FIG. 3 illustrates an embodiment of the time interval measuring instrument of the present invention. An integrator 25 is provided which comprises an operational amplifier 26, an input integrating resistor 27 connected to the input of the operational amplifier 26, an integrating capacitor 28 connected between the input and output ends of the operational amplifier 26, and a reset switch 29 connected in parallel with the integrating capacitor 28. Another integrator 31 is provided which is lower in integration rate than the abovesaid integrator 25 and is composed of an operational amplifier 32, an input integrating resistor 33, an integrating capacitor 34, and a reset switch 35 as is the case with the integrator 25. The outputs from the integrators 25 and 31 are compared by a comparator 36 for the detection of coincidence between both inputs thereto. The input side of the integrator 25 is connected via a switch 37 to a terminal 38 which is supplied with a fixed voltage $E_1$, whereas the input side of the integrator 31 is connected directly to the terminal 38. In this embodiment, since the voltage to be integrated, that is, the input voltage, is made to have the same value with respect to both integrators 25 and 31, the integration rate of the integrator 31 is made lower than that of the integrator 25 by selecting the integration time constant of the former larger than that of the latter. This can also be achieved by selecting the input voltage to the integrator 31 smaller in absolute value than the input voltage to the integrator 25, or by a combination of different integration time constants and different input voltages for the integrators 25 and 31.

In order to expand a time interval T shown in FIG. 4A, the switches 29, 35 and 37 are turned ON first and the voltage $E_1$ at the terminal 28 is integrated by the integrator 25 with the reset switch 29 alone held in the OFF state for the time T, obtaining an output depicted in FIG. 4B. At the end of the time T, the switch 37 and the reset switch 35 are turned OFF and the voltage $E_1$ is integrated by the integrator 31 to obtain such an integrated output as shown in FIG. 4C. When this integrated output coincides with the output $-V_1$ from the integrator 25, the output from the comparator 36 is inverted to become high-level as illustrated in FIG. 4D. The period $\alpha T$ from the start of integration by the integrator 31 to the inversion of the output from the comparator 36 is an expansion of the time interval T. In this case, the integrator 31 may also be actuated at a proper time after the integration by the integrator 25.

The aforementioned time intervals $\Delta T+nT_0$, $(n+1)T_0$ and $nT_0$ are sequentially expanded by controlling the switches 29, 35 and 37 through a controller 1 as is the case with the time interval T, and the expanded time intervals are each measured by supplying clock pulses to a counter 2 for each expanded time interval. The measured values or the count values of the counter 2 are provided to a calculator 3 for calculation of the aforesaid expression (1). The calculated result is displayed on a display 4.

Accordingly, even if the characteristics of the time interval expanding elements, in FIG. 3, i.e. the integrators 25 and 31 and the comparator 36, are subject to the influence of aging and ambient temperature variations, the influence is eliminated by the calculation of the expression (1) because the expansion of the time intervals $\Delta T+nT_0$, $(n+1)T_0$ and $nT_0$ undergoes the same influence.

Figures 6A, 6B, 6C, 6D, 6E, 6F, 6G, 6H, 6I, 6J, 6K, 6L, 6M, 6N:
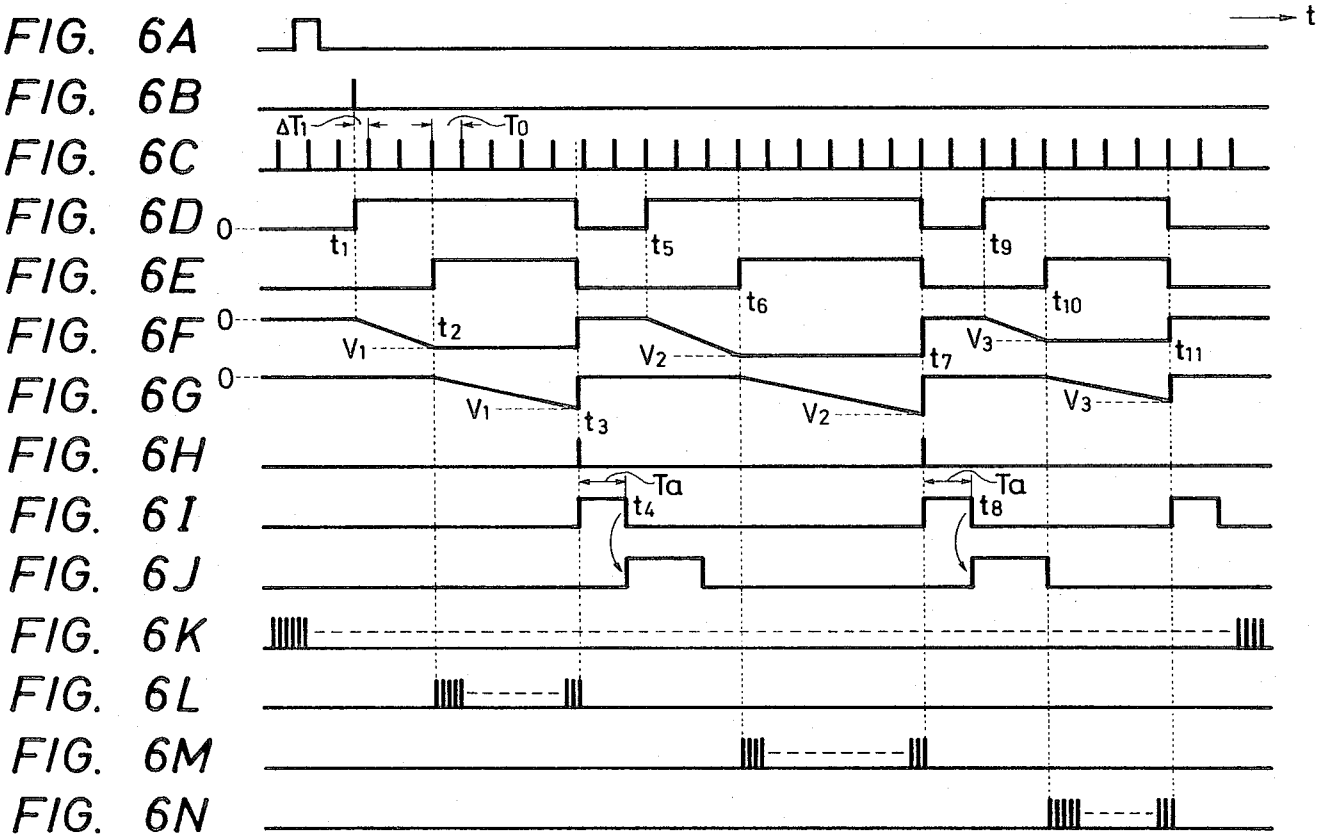
FIGS. 6A–N are timing charts explanatory of the embodiment illustrated in FIG. 5.
Figure 7:
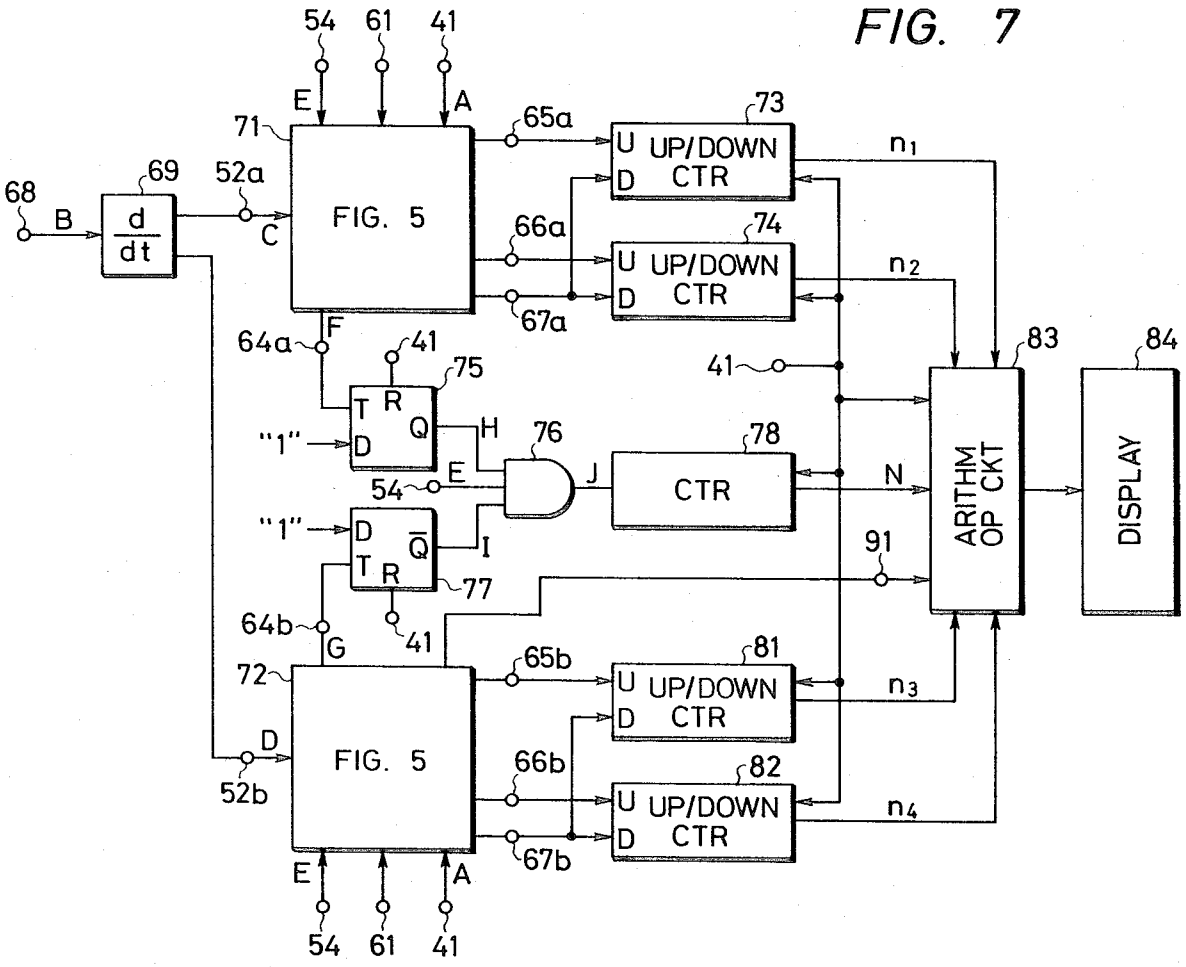
FIG. 7 is a block diagram illustrating another embodiment of the present invention as being applied to the measurement of a relatively long time interval.

Turning next to FIG. 5, a description will be given of a specific example of the time interval measuring instrument of the present invention. To a terminal 41 is applied such a reset pulse as shown in FIG. 6A, which pulse is provided via an OR gate 42 to reset terminals of D flip-flops 43, 44 and 45 and a reset terminal of a counter 46. A high-level input "1" is always applied to a data terminal of each of the flip-flops 43 and 44. The reset pulse from the terminal 41 is also applied via an OR gate 47 to a preset terminal of a D flip-flop 48 and this reset pulse is fed to a shift register 49 as well. As a result of this, Q outputs from the flip-flops 43 and 44 are made low-level and a $\overline{Q}$ output from the flip-flop 48 is also rendered low-level, and Qa, Qb and Qc outputs from the shift register 49 are set to "1", "0" and "0", respectively. In this state, the outputs from the flip-flops 43 and 44 are provided via a level converter 51 to the reset switches 29 and 35 of the integrators 25 and 31 to hold them in the ON state, retaining the integrators 25 and 31 in the reset state and, by the output from the flip-flop 44, the switch 37 is held in the ON state. The switches 29 and 35 are each a FET switch of the type that is turned ON by a high-level input to its gate, and the switch 37 is a FET switch of the type that is turned ON by a low-level input to its gate.

After this initialization, when a pulse indicating the beginning of the time interval Tx to be measured in FIG. 1 is applied to a terminal 52, for instance, at a moment $t_1$ as shown in FIG. 6B, the pulse is provided via an OR gate 53 to a trigger terminal of the flip-flop 43 to make its output high-level as depicted in FIG. 6D. In consequence, the reset switch 29 of the integrator 25 is turned OFF, permitting the integrator 25 to start integration of the voltage at the terminal 38. The integrated output gradually decreases as shown in FIG. 6F. The high-level Q output from the flip-flop 43 is applied to a data terminal of the flip-flop 45, which is, at the same time, supplied at its trigger terminal with clock pulses shown in FIG. 6C. Consequently, the output from the flip-flop 45 is made high-level by a clock pulse immediately after the moment $t_1$ and, by this high-level output and the output from the flip-flop 43, an AND gate 56 is opened, permitting the passage therethrough of the clock pulses from the terminal 54. The outputs from the AND gate 56 are counted by the counter 46.

In the example described above in respect of FIGS. 5 and 6A to N, the aforementioned number n is selected to be two and the counter 46 is so designed as to yield an output upon each counting of two. That is to say, when having counted two clock pulses, the counter 46 provides its output to the flip-flop 44 to set it at that moment $t_2$, making its output high-level as illustrated in FIG. 6E. By this high level output, the switches 35 and 37 are turned OFF to stop the integrating operation of the integrator 25 and, at its output is, a voltage $V_1$ obtained by the integration up until then is held as shown in FIG. 6F, for instance. Further, at the moment $t_2$, the reset switch 35 of the integrator 31 is turned OFF to allow it to start its integrating operation, and its output gradually decreases as depicted in FIG. 6G. The outputs from the integrators 25 and 31 are compared by the comparator 36.

The output from the flip-flop 44 is provided to AND gates 57, 58 and 59, which are supplied with the Qa, Qb and Qc outputs from the shift register 49, respectively. Moreover, clock pulses, which are faster, for instance, by an order of magnitude than the clock pulses from the terminal 54 as shown in FIG. 6K, are supplied from a terminal 61 to the AND gates 57, 58 and 59 in common to them. Consequently, in the initial state, the Qa output from the shift register 49 is high-level and, after the moment $t_2$, the output from the flip-flop 44 becomes high-level, so that the gate 57 is opened, permitting the passage therethrough of the high-speed clock pulses from the terminal 61 as depicted in FIG. 6L. Having detected that the output from the integrator 31 has reached $V_1$, the comparator 36 yields a high-level output, which is fed to the OR gate 42, resetting the flip-flops 43, 44 and 45 and the counter 46. By the resetting of the flip-flop 44 the switch 35 is turned ON. As a result, the output from the integrator 31 immediately becomes low-level as shown in FIG. 6G, and the output from the comparator 36 also becomes low level.

At a moment $t_3$ when the output from the flip-flop 44 has become low-level, a timer 62 is driven to produce an output which remains high-level for a fixed period of time Ta and returns to the low level at a moment $t_4$ as shown in FIG. 6I. By the output change of the timer 62 from the high to the low level at the moment $t_4$, the shift register 49 is driven to make its Qa output low-level while the Qb output high-level. Further, the output from the timer 62 is also applied to the flip-flop 48 to drive it and, in this case, since the low-level from the Qc output of the shift register 49 is applied to the data terminal of the flip-flop 48, its $\overline{Q}$ output rises to the high-level at the moment $t_4$ as illustrated in FIG. 6J. A gate 63 is opened by the high-level $\overline{Q}$ output from the flip-flop 48 and a clock pulse fed from the terminal 54 immediately after the moment $t_4$ is provided via the gates 63 and 53 to the flip-flop 43, making its output high-level at a moment $t_5$ as shown in FIG. 6D. Thus the integrator 25 resumes its integrating operation as depicted in FIG. 6F. By the next clock pulse from the terminal 54, the output from the flip-flop 45 is made high-level, hence the next successive clock pulse from the terminal 54 is applied via the gates 56 and 47 to the preset terminal of the flip-flop 48 to set it and its $\overline{Q}$ output becomes low-level as shown in FIG. 6J and, at the same time, the clock pulses from the terminal 54 are counted by the counter 46. Accordingly, when the counter 46 counts two clock pulses, the flip-flop 44 is set at that moment $t_6$ and yields a high-level output as shown in FIG. 6E, causing the integrator 31 to start its integrating operation. The integrated output from the integrator 31 gradually diminishes as indicated in FIG. 6G. Since the Qb output from the shift register has been "1" at the beginning of the integration, the gate 58 is opened by the output from the flip-flop 44 to pass therethrough the high-speed clock pulses from the terminal 61 after the moment $t_6$.

Upon coincidence of the output from the integrator 31 with the output $V_2$ from the integrator 25, the comparator 36 produces a high-level output at that moment $t_7$ as in the case described previously, which output is provided via the gate 42 to the flip-flops 43, 44 and 45 and the counter 46 to reset them. In consequence, the timer 62 is driven and, at a moment $t_8$ after the period Ta during which the timer 62 was driven, the flip-flop 48 is triggered. At the same time, the shift register 49 is shifted and its Qc output becomes high-level and is provided to the flip-flop 45 to set it. At a moment $t_9$ when the next clock pulse is applied from the terminal 54, the flip-flop 43 is set to yield a high-level output as depicted in FIG. 6D and this output is provided to the integrator 25 to start its integrating operation as illustrated in FIG. 6E. Since the output from the flip-flop 43 is high-level and since the output from the flip-flop 45 has already been made high-level by the Qc output from the shift register 49, the clock pulses from the terminal 54 pass through the gate 56. Upon passage of two clock pulses from the terminal 54 through the gate 56 after the moment $t_9$, the counter 46 provides its output to the flip-flop 44 to trigger it, thereby opening the switch 37, and at the same time, causing the integrator 31 to start its integrating operation at that moment $t_{10}$. At this time, the gate 59 is opened to permit the passage therethrough of the high-speed clock pulses from the terminal 61 as depicted in FIG. 6N. When the output voltage $V_3$ from the integrator 25 and the output voltage from the integrator 31 at that time coincide with each other, the comparator 36 provides an output at that moment $t_{11}$, by which the flip-flops 43 and 44 are reset, closing the gate 59. Simultaneously with this, the timer 62 is also driven to yield an output as shown in FIG. 6I and, by the fall of this output, the flip-flop 48 is driven but, as its data terminal is being supplied with the high-level output from the terminal Qc of the shift register 49 at that time, the $\overline{Q}$ output from the flip-flop 48 does not become high-level and, consequently, the clock pulses from the terminal 54 are inhibited from the passage through the gate 63, providing the initial state.

In the manner described above, high-speed clock pulses corresponding in number to the three time intervals $\Delta T_1+nT_0$, $(n+1)T_0$ and $nT_0$ are derived from the gates 57, 58 and 59 at the beginning of the time interval Tx to be measured in FIG. 1. Also at the end of the time interval Tx, a trigger pulse is applied to the terminal 52, by which three time intervals $\Delta T_2+nT_0$, $(n+1)T_0$ and $nT_0$ corresponding to the abovesaid ones are automatically measured in the same manner as described previously. Incidentally, the flip-flop 43 in FIG. 5 constitutes a switching signal generator which produces a switching signal for controlling the switch 29; the flip-flop 44 constitutes a switching signal generator which produces a switching signal for controlling the switches 35 and 37; the shift register 49 constitutes a sequencer for measuring the time intervals $\Delta T_1+nT_0$, $(n+1)T_0$ and $nT_0$ in a sequential order; and the flip-flop 45, the gate 56 and the counter 46 make up delay means for obtaining delayed output of the time interval $nT_0$ or $(n+1)T_0$ synchronized with a clock pulse after the flip-flop 43 was triggered. The delay of the time interval $nT_0$ or $(n+1)T_0$ is dependent on the output state of the sequencer 49. Furthermore, the flip-flop 48 and the gates 47 and 63 serve as clock-synchronized trigger generating means for triggering the flip-flop 43 other than the triggering of the flip-flop 43 by the pulses from the terminal 52. This trigger generating means is triggered by the output from the flip-flop 44 via the timer 62. In FIG. 5, the parts other than the integrators 25 and 31, the comparator 36 and the switch 37 form the controller 1 in FIG. 3, which produces the time intervals $\Delta T_1+nT_0$, $(n+1)T_0$ and $nT_0$ in response to the input pulse and controls each switch. By selecting the rate of expansion of each of the time intervals $\Delta T_1+nT_0$, $(n+1)T_0$ and $nT_0$ to be sufficiently high, it is possible to employ, as the clock pulses to the terminal 61, clock pulses of the same speed as those which are applied to the terminal 54.

Next, a description will be given, with reference to FIGS. 7 and 8A to K, of the measurement of the time interval Tx of FIG. 1A through utilization of the above-described method for measuring such very short time intervals. At the moment $t_1$, such a reset pulse as shown in FIG. 8A is provided from the terminal 41 to the time interval measuring instrument to reset it to its initial state. In this state, a pulse of the time interval Tx desired to be measured, shown in FIG. 8B, is applied from a terminal 68 to a differentiator 69, from which the differentiated outputs respectively corresponding to the rise and fall of the input pulse, such as depicted in FIGS. 8C and 8D, are provided to first and second fraction measuring units 71 and 72, respectively. The fraction measuring units 71 and 72 are identical in construction with the measuring circuit illustrated in FIG. 5. Accordingly, they are supplied with the reset pulses from the terminal 41, the first clock pulses from the terminal 54 and the high-speed second clock pulses from the terminal 61.

In the fraction measuring unit 71, pulses of the time intervals $\Delta T_1+nT_0$, $(n+1)T_0$ and $nT_0$ are produced in the manner described previously, and the numbers of second clock pulses corresponding to the durations of the abovesaid three intervals are derived at terminals **65*a*, 66*a* and 67*a* corresponding to the output terminals 65, 66 and 67 in FIG. 5, respectively. The clock pulses at the terminals 65*a* and 66*a* are respectively up-counted by up-down (reversible) counters 73 and 74, whereas the clock pulses at the terminal 67*a* are down-counted by the counters 73 and 74. The output at an output terminal 64*a* of the fraction measuring unit 71 corresponding to the output terminal 64 of the flip-flop 44 in FIG. 5 is applied to a trigger terminal T of a flip-flop 75, which is reset in advance, and a high-level input "1" is continuously applied to its data terminal D. Accordingly, a Q output from the flip-flop 75 is rendered high-level, as shown in FIG. 8H, by the rise of a first pulse (at the moment $t_2$ in FIG. 6E) from the terminal 64*a*, and the high-level output is provided to a gate 76. On the other hand, a $\overline{Q}$ output from a flip-flop 77, which is reset in advance by the reset pulse from the terminal 41, is applied as a high-level input to the gate 76 as depicted in FIG. 8I. At the same time, the gate 76 is supplied with first clock pulses, shown in FIG. 8E, from the terminal 54. Accordingly, from the moment $t_2$, the first clock pulses pass through the gate 76, as shown in FIG. 8J, and are counted by a counter 78**.

In the second fraction measuring unit 72, a pulse occurring at the end of the time interval Tx (FIG. 8D) is provided, by which are produced pulses of durations $\Delta T_2+nT_0$, $(n+1)T_0$ and $nT_0$. Second clock pulses corresponding in number to the durations of these three pulses respectively appear at terminals 65*b*, 66*b* and 67*b* corresponding to those 65, 66 and 67 in FIG. 5. Then, as is the case with the first fraction measuring unit 71, the pulses derived at the terminals 65*b* and 66*b* are up-counted by reversible counters 81 and 82, respectively, and their count values are then down-counted by the pulses at the terminal 67*b*. From the second fraction measuring unit 72, an output (FIG. 8G) resulting from the pulse (FIG. 8D) produced at the end of the time interval Tx is applied to a trigger terminal T of the flip-flop 77 via a terminal 64*b* corresponding to the terminal 64 in FIG. 5 and, by the rise of the output at the terminal 64*b*, a high-level input is read in the flip-flop 77 to render its $\overline{Q}$ output low-level at the moment $t_3$ as shown in FIG. 8I. As a result, the counting of the first pulses by the counter 78 comes to an end.

The count values $n_1$ and $n_2$ of the counters 73 and 74 the count values $n_3$ and $n_4$ of the counters 81 and 82 and the count value N of the counter 78 are provided to an arithmetic operation circuit 83. In the second fraction measuring instrument 72, the output from the timer 62 and the Qc output from the shift register 49 are ANDed by the gate 89 (see FIG. 5) and its output (FIG. 8K) is applied via a terminal 91 to the arithmetic operation circuit 83 to start its arithmetic operation. In the arithmetic operation circuit 83, the expression $$\left(N+\frac{n_1}{n_2}-\frac{n_3}{n_4}\right)\times T_0$$

is calculated. The calculated result is the time interval Tx desired to be obtained, which is displayed on a display 84.

With such an arrangement as shown in FIG. 9 in which the difference between the outputs from the integrators 25 and 31 is amplified by a differential amplifier 87 and the amplified output is compared by the comparator 36 with the zero level, the measurement accuracy can be raised by increasing the gain of the differential amplifier 87. Incidentally, the present invention is applicable not only to the measurement of time intervals but also to the measurement of periods and frequencies using reciprocals of the periods.

It will be apparent that many modifications and variations may be effected without departing from the scope of the novel concepts of the present invention.

What is claimed is:

1. An interval-expanding timer for measuring a time interval $\Delta T$ between an input signal and the first subsequent clock pulse of a clock signal with period $T_0$ by measuring three time intervals, namely a time interval $\Delta T+nT_0$ of the sum of the time interval $\Delta T$ and a time interval $nT_0$, and time intervals $(n+1)T_0$ and $nT_0$, respectively, wherein n is a positive integer, said timer comprising:

a voltage source for providing a constant voltage;

a first integrator having as an input said constant voltage for integrating same for a first period of time and for outputting a corresponding integration value;

switch means inserted between said voltage source and the input of said first integrator;

a second integrator having as an input said constant voltage for integrating same for an expanded interval corresponding to said first period of time, with an integration time constant that is larger than that of the first integrator and for outputting a respective integration value;

coincidence detecting means directly connected to the outputs of said first and second integrators for producing a coincidence signal upon detecting coincidence between said integration values to determine the end of the respective expanded interval;

time interval measuring means for providing data corresponding to the length of said expanded interval, namely from the start of the integration by said second integrator to the occurrence of said coincidence signal;

control means for controlling said first and second integrators, said time interval measuring means and said switch means to operate said first integrator to perform said integration using each of said three time intervals as said first period of time, and after operating said first integrator for each respective one of the three time intervals, to operate said second integrator and said time interval measuring means for the respective expanded interval to provide the respective data; and means for calculating the time interval $\Delta T$ using said respective data for the values of said three time intervals in $T_0((\Delta T+nT_0)-nT_0)/((n+1)\ T_0-nT_0)$.

2. The timer of claim 1, wherein each said integration by the second integrator for providing the respective data of the respective expanded interval is performed prior to the respective integration by said first integrator for the subsequent one of said three time intervals.

3. The timer of claim 1, wherein said coincidence detecting means comprises a comparator for comparing said outputs of said first and second integrators and for providing an output that changes polarity upon said detecting of coincidence.

4. The timer of claim 3, wherein said coincidence detecting means includes a differential amplifier for amplifying the difference between the outputs of said first and second integrators for said detecting of coincidence.

5. The timer of claim 1, said control means comprising:

a first switching signal generator which is triggered by said input signal for causing said first integrator to begin the integration of said constant voltage for the first period of time corresponding to the $\Delta T+nT_0$ one of said three time intervals, and by two respective trigger signals for said first periods corresponding to the others of said three time intervals;

a sequencer for providing an output for controlling the sequence of said integrating and said providing of said data for said three time intervals;

delay means triggered by said first switching signal to provide an output corresponding to time delays of $nT_0$ and $(n+1)T_0$ in accordance with the output of the sequencer;

a second switching signal generator which is triggered by the output of the delay means to output a second switching signal to define the end of each respective first period of the integrating of the first integrator and for determining the beginning of each respective second period; and a clock-synchronized trigger generating means which is triggered by said second switching signal to generate said two respective trigger signals for said first switching signal generator.

6. The timer of claim 5, comprising means for resetting said first and second switching signal generators and said delay means by said coincidence signal.

7. The timer of claim 5, comprising means for providing a logic function of said output of said sequencer and of said second switching signal for determining said expanded intervals for said three time periods.

8. The timer of claim 5, said delay means comprising a counter which outputs a signal upon each counting of n of said clock pulses, and means for delaying the clock pulses supplied to said counter by one clock pulse depending on said output of the sequencer.

9. The timer of claim 2 or 5, for measuring a time interval Tx between two of said input signals, comprising:

measuring means for measuring two time intervals $\Delta T_1$ and $\Delta T_2$ each corresponding to said time interval $\Delta T$, wherein $\Delta T_1$ and $\Delta T_2$ are the respective time periods between the first and second of said input signals and the respective successive ones of said clock pulses;

means for counting the number N of said clock pulses occurring between said two input signals; and means for calculating said time interval Tx as $NT_0+\Delta T_1-\Delta T_2$.

10. The timer of claim 9, wherein said input signals are selected so that N is sufficiently large to allow said first and second integrators to be used to measure both said time intervals $\Delta T_1$ and $\Delta T_2$.

11. The timer of claim 9, said measuring means comprising:

two sets of said first and second integrators, of said coincidence detecting means, of said time interval measuring means, and of said control means for determining respective data on the expanded intervals of respective sets of said three time period; and further control means for being able to measure said two time intervals $\Delta T_1$ and $\Delta T_2$ at least in part at the same time.

12. The timer of claim 11, comprising:

two pulse output means for outputting respective clock pulses during operation of each second integrator for each of said three time intervals of each of said time intervals $\Delta T_1$ and $\Delta T_2$;

two pairs of up-down counters, each said pair being connected to a respective one of the pulse output means for counting in a predetermined manner the respective clock pulses during the respective expanded intervals to provide respective count values $n_1$, $n_2$ and $n_3$, $n_4$; and arithmetic means for computing said time period Tx as $(N+n_1/n_2-n_3/n_4)T_0$.

13. The timer of claim 2 said means for calculating including two up-down counters connected to receive in a predetermined manner said clock pulses during each said second period, for providing respective count values $n_1$ and $n_2$ after the expanded intervals of said three time intervals, wherein said time interval $\Delta T$ is calculated according to $(n_1/n_2)T_0$.

14. A timer, for measuring a time interval $\Delta T$ between the occurrence of an input signal supplied thereto and the first clock pulse following said input signal of a first clock signal having period $T_0$ also supplied thereto, comprising:

a first integrator for integrating a first constant voltage for three successive first periods of time $\Delta T+nT_0$, $nT_0$ and $(n+1)T_0$ in a predetermined order, n being a positive integer, and for holding and outputting each integrated value for a respective holding period prior to performing the integration for the next first period of time;

a second integrator for integrating a second constant voltage for three respective expanded intervals corresponding to said three periods of time, wherein the combination of the relative magnitude of said second constant voltage with respect to said first constant voltage and the time constants of said first and second integrators are such that each said expanded interval is longer than the respective first period;

coincidence signal means supplied successively with respective pairs of said integrated values from said first and second integrators for corresponding one of said first periods of time and expanded intervals, for outputting a coincidence signal when the output of said second integrator equals the respective integrated value that is being held by said first integrator;

a second clock for providing second clock pulses;

counting means for counting said second clock pulses during each said expanded interval; and control means for controlling said first and second integrators to perform said integrating, so as to output from said first integrator the integrated value held therein and the respective output of said second integrator to said coincidence means for detecting said coincidence;

wherein said time interval $\Delta T$ is determined using the count values of the counting means corresponding to said three respective periods of time in the formula $((\Delta T+nT_0)-nT_0)/((n+1)T_0-nT_0))$.

15. The timer of claim 14, said first constant voltage being the same as said second constant voltage.

16. The timer of claim 14, said first clock signal being the same as said second clock signal.

17. The timer of claim 14, comprising:

two up-down counters, the first up-down counter having as inputs the second clock pulses during said expanded intervals corresponding to $\Delta T+nT_0$ and $nT_0$ and outputting the difference $n_1$ therebetween, and the second of said up-down counters having as inputs the second clock pulses during said expanded intervals corresponding to $(n+1)T_0$ and $nT_0$ and outputting the difference $n_2$ therebetween;

wherein said time interval is given by $(n_1/n_2)T_0$.

* * * * *